United States Patent [19]

Ellis

[11] Patent Number: 4,569,377

[45] Date of Patent: Feb. 11, 1986

[54] SEALED BARRIER CONTAINER

[76] Inventor: John P. Ellis, 209 Lincoln Mall Shopping Center, Matteson, Ill. 60443

[21] Appl. No.: 616,916

[22] Filed: Jun. 4, 1984

[51] Int. Cl.[4] ..... B65B 1/04

[52] U.S. Cl. ..... 141/98; 141/114; 141/314; 141/391

[58] Field of Search ..... 141/10, 67, 68, 114, 141/313–317, 391, 98

[56] References Cited

U.S. PATENT DOCUMENTS 4,344,468 8/1982 Sandberg ..... 141/114

*Primary Examiner*—Houston S. Bell, Jr.
*Attorney, Agent, or Firm*—Basil E. Demeur

[57] ABSTRACT

There is provided a sealed container for accommodating a plurality of product in bulk form, and providing limited access thereto for a user to withdraw a portion of said products from said container, the sealed barrier formed by a bottom wall, side walls, a top wall and a front wall, one of the walls provided with a first aperture bound by a perimeter delineating an opening for access to the interior confines of the container, a flexible pouch barrier having a perimetric opening and being sealed around the perimeter of the first aperture, the flexible pouch barrier positioned within the interior confines of the container, the flexible barrier being sufficiently flexible and pliable to adjust to the contour of the hand of the user, and a second aperture formed in the wall which accommodates the first aperture, the second aperture being positioned adjacent to the first aperture and providing an exit pathway from the interior confines of the container to permit the removal of product from the container while the remainder of the product remains in sterile condition.

1 Claim, 3 Drawing Figures

FIG. 1
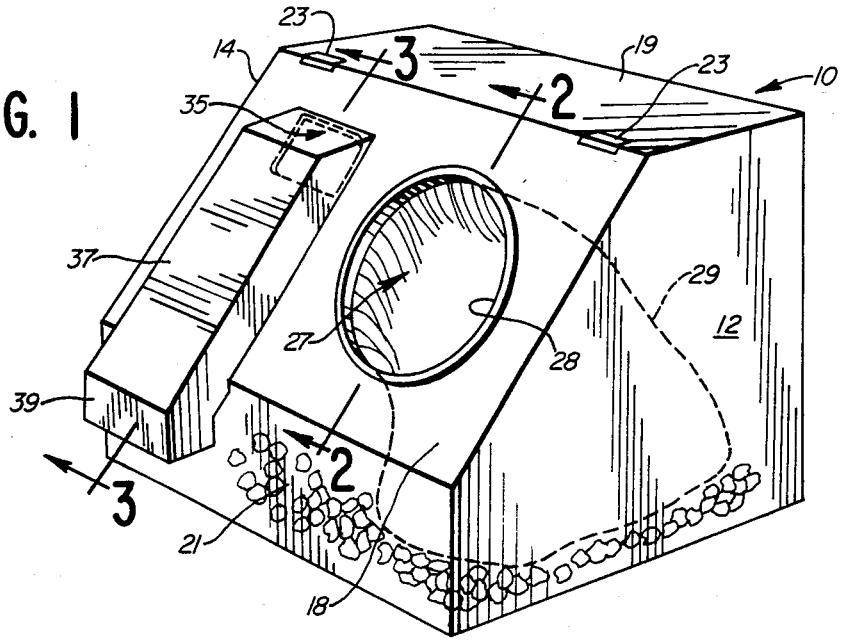
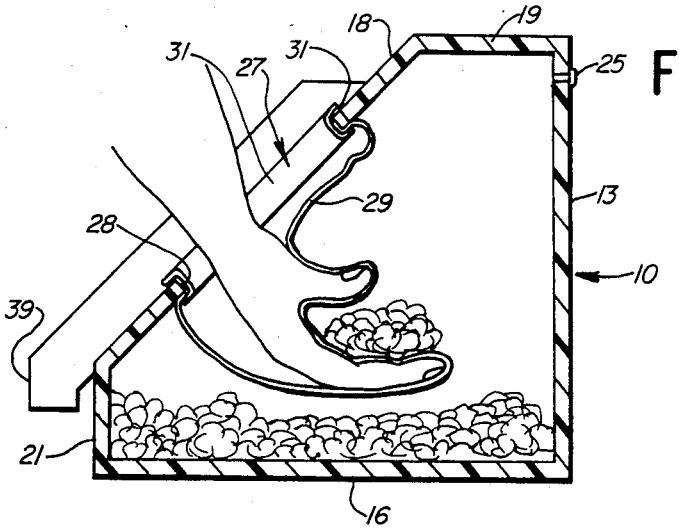
FIG. 2
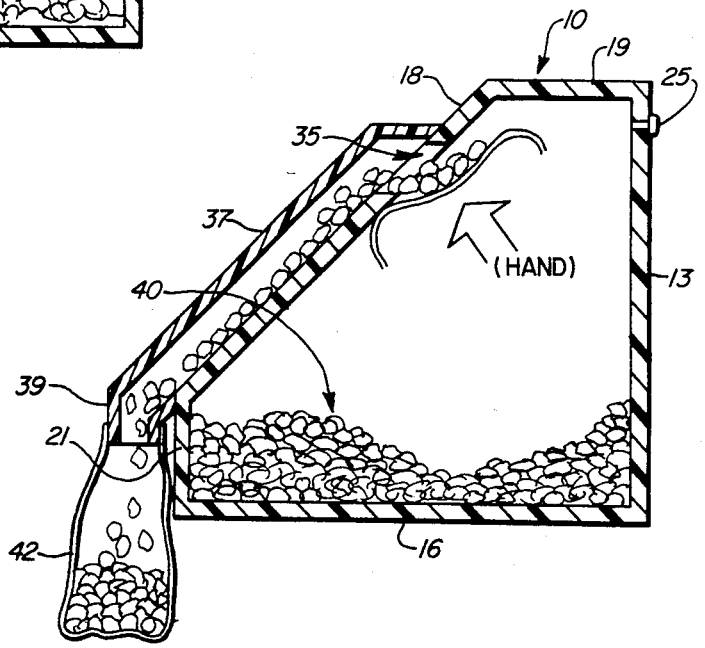
FIG. 3

SEALED BARRIER CONTAINER

BACKGROUND OF THE INVENTION

It will be appreciated that in many applications, various products are sold in bulk form to the consuming public, such as in bins or the like, which permits the consumer to purchase any desired quantity of the product from the bulk container. This is especially true in connection with food products, since many food products are still sold in bulk form in order to permit the consumer to purchase a small quantity of the product contained in bulk form. For example, products such as fruits and vegetables, nuts, candies, and the like are often contained within a bin, permitting the user to then obtain a receptacle such as a bag or the like, and to withdraw from the container such portion of the product as the consumer wishes to purchase.

It has become necessary however, to insure the sterility of the product, and to further prevent unauthorized tampering with a product contained in the bin, in view of the fact that food and drug tampering has now become a serious problem. One solution to the problem has been to take product typically sold in bulk form and bins, and to package the same in certain weight formats, the product being pre-packaged by the vendor thereof. Hence, it is well known that food products such as potatoes, tomatoes, candies, and the like are now prepackaged in certain weight formats, which permits the consumer to purchase only those packages of the designated weight. However, it is still deemed to be desirable to provide the consumer with the option of purchasing any desired weight format of a product available in bulk form, with the consumer selecting the particular product weight which he wishes to purchase. Hence, the problem of maintaining the sterility and product integrity of the product in bulk form when contained in a bin has not been addressed.

The present invention is intended to provide a system whereby any product may still be contained in the bulk format, and contained within a bin, permitting the consumer to purchase any desired weight quantity thereof, while still maintaining product sterility and integrity. In addition, the present invention is intended to provide the vendor with the means to easily verify and confirm that the product integrity is maintained at all times.

In terms of prior art type devices, sealed containers are generally known, but usually in connection with scientific apparatus. In such applications, the sealed container is intended to provide a controlled atmospheric environment for the conducting of an experiment, or otherwise working with dangerous materials. For example, U.S. Pat. No. 4,059,903 is directed to a controlled environment work enclosure wherein dangerous materials may be handled by the user by inserting his hands through openings provided in the container, the openings being sealed by appropriate barriers containing flexible gloves such that the user may simply insert his hands through the barrier into the gloves, and then gain access to the materials to be manipulated.

Similar comments are applicable with respect to the device shown in U.S. Pat. No. 4,111,753, wherein there is disclosed an anaerobic incubator which in effect provides a controlled atmospheric apparatus wherein the user gains access, once again, through a pair of sealed barriers providing rubber gloves within the interior confines of the container such that the user may insert his hands therethrough, and manipulate the items to be worked with within the interior confines of the container.

With respect to food products, U.S. Pat. No. 2,039,490 shows an apparatus for peeling vegetables wherein the operator may insert his hands through a pair of openings provided in the container, although it will be noted that this device does not provide a sterile or tamperproof enclosure since the purpose of the bellows through which the user places his hands is merely to retain the peelings from the vegetables within the container, and therefore, sterility is not maintained.

Other similar devices are shown in the prior art, but as indicated previously, such devices have as their intention, the maintenance of a controlled environment within the container, totally sealed off from the external atmosphere, with limited access provided only for the purpose of manipulating items within the container.

The present invention is intended to provide a sealed container which provides limited access by the user thereof to the interior confines of the container in order to obtain and withdraw a portion of a product contained therein in bulk form, such that an exit pathway must be provided in order to withdraw the product from the container.

OBJECT-AND ADVANTAGES

It is therefore the principal object of the invention to provide a sealed container formed by a plurality of walls thereby to completely enclose the interior confines thereof, with a first aperture provided, the first aperture being defined by a perimetric opening for access to the interior confines of the container, and a flexible pouch barrier being provided with a perimetric opening, such that the perimetric opening of the flexible pouch barrier may be sealed to the perimetric opening defining the first aperture, with the flexible pouch barrier being contained within the interior confines of the container. The container is then provided with a second exit aperture providing an exit pathway for the product withdrawn from the container, such that the user grasping and withdrawing a quantity of product from the container eliminates any contact with either the product withdrawn, or the product remaining in the container.

In connection with the foregoing object, it is a further object of the invention to provide a container of the type described, wherein the flexible pouch barrier having a perimetric opening is removably sealed to the perimetric opening of the first aperture by means of a removable gasket in order to accommodate the removal and replacement of the sealed pouch barrier from time to time, as the same may become ruptured, torn or otherwise unusable.

In connection with the foregoing objects, it is a further object of the invention to provide a container of the type described wherein the second aperture providing an exit pathway is provided with an exit chute extending along the front wall of the container, the chute terminating in a receptacle receiving collar, such that the user may insert a collection receptacle surrounding the collar, such that product withdrawn from the container and released through the second aperture will follow the pathway of the exit chute, through the exit collar and into the receptacle provided by the consumer, such that product sterility is maintained at all times.

Further features of the invention pertain to the particular arrangement of the elements and parts whereby the above-outlined and additional operating features thereof are attained.

The invention, both as to its organization and method of operation, together with further object and advantages thereof, will best be understood by reference to the following specification, taken in connection with the accompanying drawings.

BRIEF DESCRIPTION OF THE DRAWINGS

FIG. 1 is a perspective view showing the sealed barrier container of the present invention, including the means of access thereto, and the means of withdrawing product therefrom;

FIG. 2 is a side elevational view, in cross section, taken in the direction of the arrows along the line 2—2 of FIG. 1, showing the method by which the flexible pouch barrier operates to maintain product sterility when in use; and FIG. 3 is a side elevational view in cross section, taken in the direction of the arrows along the line 3—3 of FIG. 1, again showing the means by which the product may be withdrawn from the container via the exit pathway, and be deposited in a suitable receptacle provided by the consumer.

SUMMARY OF THE INVENTION

In summary, the present invention is intended to provide a bin or a container which is adapted to accommodate a plurality of a product in bulk form, and permits the consumer to gain access to the container for the withdrawal of a portion of the product contained therein, while at the same time maintaining product sterility of both the product withdrawn, as well as the product remaining within the bin despite access by the consumer. The sealed container of the present invention is provided with a flexible pouch barrier which is sealed around the access opening, but is sufficiently flexible and pliable to adapt to the contour of the user's hand, such that the user may grasp and withdraw any desired quantity of the product contained within the container, by releasing the same through the second aperture which forms an exit pathway from the interior confines of the container. The second aperture may ideally be provided with an exit chute, terminating in a receptacle receiving collar affording the user the opportunity to position a receptacle about the collar, such that the product withdrawn and released through the exit chute will be deposited automatically in a receptacle provided by the consumer, such that product sterility is maintained at all times.

It will also be appreciated that the vendor which provides the container for and on behalf of the consumer may easily confirm and verify that the product is maintained in a sterile condition by simply checking the condition of the flexible pouch barrier from time to time. In the event that any tears or other interruptions are noted in the flexible pouch barrier, the product within the container may be replaced, and a fresh pouch barrier may be installed on the container thereby to insure that the product contained within the container remains in sterile condition.

DETAILED DESCRIPTION OF DRAWINGS

With respect to FIG. 1, the sealed barrier container 10 of the present invention is illustrated. It will be observed that container 10 is formed by side walls 12 and 14, a back wall 13, a bottom wall 16, a front wall 18, a top wall 19, and a lower front support panel 21. The top wall 19 is shown to be hingedly secured to the front wall 18 by means of a pair of hinges 23 which permits the top wall 19 to be pivotly moved to an open position in order to permit the vendor to position bulk products within the confines of the container 10. If desired, and where deemed necessary, the top wall 19 may be secured to the back wall 13 by means of a lock generally shown by the numeral 25. The locking arrangement between the top wall 19 and the back wall 13 may be of any suitable construction as may be commercially available at the present time. The purpose of the lock assembly 25 is to eliminate the possibility of an unauthorized person gaining access to the interior confines of the container with the purpose of contaminating the product contained therein.

The front wall 18 is shown to be provided with a first aperture 27 which, in the present embodiment, is shown to be circular in configuration, and of a sufficient diametric sizing to permit the user to insert their entire hand therethrough, as shown in FIG. 2 of the drawings. There is further provided a flexible pouch barrier 29 which is bound by a perimetric opening generally designated by the numeral 31. Similarly, the first aperture 27 contained in the front wall 18 is bound by a perimetric opening 28. The perimetric opening 31 of the flexible pouch barrier 29 is shown to be secured to the perimetric opening 28 which delineates the first aperture 27, with the pouch barrier being positioned within the interior confines of the container 10.

In the embodiment as illustrated in FIGS. 1 and 2 of the drawings, it will be observed that the flexible pouch barrier 29 is sufficiently flexible and pliable in order to accommodate the hand of the user therein, and also is adjustable to the contour of the hand thereby to facilitate the task of grasping segregated articles from within the container.

In the preferred embodiment as illustrated, the perimetric opening 31 of the pouch 29 is sealed to the perimetric opening 28 of the first aperture 27 by means of a gasket 33 which is circular in configuration, and operates to form a tight seal as between the pouch 29 and the aperture 27.

The front wall 18 is shown to further include a second exit aperture 35 which is positioned adjacent to the first aperture 27. Again, in the preferred embodiment, the second aperture is shown to be surrounded by an exit chute 37 which extends downwardly along the front wall 18 and terminates in a receptacle receiving collar 39.

As is evident from FIGS. 2 and 3 of the drawings, the container is filled by depositing into the container a plurality of product in bulk form, generally denoted by the numeral 40, which is deposited through the top wall 19 by unlocking lock 25, and hingedly opening the top wall 19. The product 40 is maintained in the container 10 in secure fashion by reengaging the lock 25. It will be evident that the consumer may then remove any quantity of the bulk product 40 as desired, by inserting his hand through the aperture 27 and into the flexible pouch barrier 29. Given the flexibility and pliability of the barrier 29, the consumer may scoop up or grasp the desired quantity of product 40, and then push the same through the exit aperture 35 such that the product 40 travels down the chute 37 and out of the exit collar 39. As is again shown in FIG. 3 of the drawings, the consumer may position a receptacle 42 in surrounding relation to the collar 39, such that the product 40 that travels down the chute will automatically be fed into the receptacle 42.

In the manner as indicated above, the sterility and integrity of product 40 contained within the container 10 is maintained at all times since the consumer's hand does not actually touch the product being purchased. In addition, the purchaser is now in a position to purchase any desired weight quantity of the product as desired, and is not required to purchase a prepackaged portion thereof.

Furthermore, it will be appreciated that the vendor who is responsible for loading the container 10 with the product 40, may easily determine the continued product sterility and integrity by simply checking the integrity of the pouch 29 to insure that there are no tears or other interruptions in the integrity of the flexible pouch. If it is determined that there is a tear, or other interruption in the integrity of the pouch, it will be appreciated that the flexible pouch barrier 29 may be removed by simply removing the gasket 33 to remove the pouch from the perimetric opening 28 of the first aperture 27, and applying a new pouch 29 therein, and then reinserting the gasket 33.

It will further be observed that the chute 37 extends for a substantial distance along the front wall 18 of the container 10, and as such, renders it virtually impossible for any unauthorized person to insert their hand up through the chute 37, through the exit aperture 35, and into the container thereby to contaminate or otherwise interfere with the product integrity. If desired, an interior flap (not shown) may be inserted over the interior portion of the second exit aperture 35 such that the flap only moves outwardly when the consumer's hand is pushed through the second exit aperture 35 to release product 40 down the chute 37. This will further insure the integrity and sterility of the product contained within the container 10.

It will be appreciated from the above description that a sealed barrier container 10 as contemplated by the present invention is provided which is especially adapted to contain both food product for sale directly to the consumer, which nevertheless maintains product sterility and integrity. Hence, such food products as nuts, candles, vegetables, and the like may be sold from a bulk supply to the consumer affording the consumer the opportunity to purchase any weight quantity thereof as may be desired.

It will further be appreciated that the container of the present invention may similarly be employed in connection with other products sold in bulk form wherever the need for sterility and product integrity is deemed desirable or necessary.

While there has been described what is at present considered to be preferred embodiments of the invention, it will be understood that various modifications may be made therein and it is intended to cover in the appended claims all such modifications as fall within the true spirit and scope of the invention.

I claim:

1. A sealed barrier container providing limited access to the interior confines of the container and adapted to contain a supply of bulk product, comprising in combination, a container bound by a bottom wall, side walls, a top wall and a front wall, one of said walls provided with a first aperture formed therein and bound by a perimeter delineating an opening for access to the interior confines of said container, a flexible pouch barrier having a perimetric opening and being sealed around the perimeter of said first aperture and positioned within the interior confines of said container, said flexible pouch barrier being sufficiently flexible and pliable to adjust to the contour of the hand of the user thereof, a removable gasket for sealing said perimetric opening of said flexible pouch barrier to the perimetric opening of said first aperture such that said flexible pouch barrier may be removed for replacement purposes from said first aperture, a second exit aperture formed in the same wall accommodating said first aperture, said second aperture being positioned adjacent to said first aperture, and providing an exit pathway from the interior confines of said container, an exit chute overlying said second aperture and extending along the corresponding wall of said container and terminating in a receptacle-receiving collar to accommodate the insertion of the receptacle thereover such that bulk product exiting through said second exit aperture and down said chute will be deposited in said receptacle, whereby said flexible barrier permits the user to insert their hand through said first aperture to gain access to the contents of said container with said flexible barrier interposed between the user's hand and the contents of said container, and to grasp a plurality of the contents therein and to release the same through said second aperture thereby to maintain the contents of said container in a sterile condition.

* * * * *